US010667353B2

(12) United States Patent
Hwang et al.

(10) Patent No.: US 10,667,353 B2
(45) Date of Patent: May 26, 2020

(54) LIGHTING SYSTEM OF ALTERNATE CURRENT LIGHT-EMITTING DIODES

(71) Applicant: JITBoundary United Production Inc., Taoyuan (TW)

(72) Inventors: Ying-Diean Hwang, Taoyuan (TW); Po-Wen Ko, Taoyuan (TW)

(73) Assignee: JITBoundary United Production Inc., Taoyuan (TW)

( * ) Notice: Subject to any disclaimer, the term of this patent is extended or adjusted under 35 U.S.C. 154(b) by 0 days.

(21) Appl. No.: 16/249,970

(22) Filed: Jan. 17, 2019

(65) Prior Publication Data

US 2019/0230761 A1 Jul. 25, 2019

(30) Foreign Application Priority Data

Jan. 19, 2018 (TW) ..... 107101933 A

(51) Int. Cl.
*H05B 45/10* (2020.01)
*H05B 45/37* (2020.01)
*H05B 45/44* (2020.01)

(52) U.S. Cl.
CPC ..... *H05B 45/10* (2020.01); *H05B 45/37* (2020.01); *H05B 45/44* (2020.01)

(58) Field of Classification Search
CPC ..... H05B 33/0845; H05B 33/0815; H05B 33/0824
See application file for complete search history.

(56) References Cited

U.S. PATENT DOCUMENTS

2011/0279047 A1 11/2011 Choi et al.
2017/0251534 A1 8/2017 Jung et al.

FOREIGN PATENT DOCUMENTS

TW M393127 11/2010
TW 201127191 8/2011
TW M532705 11/2016

OTHER PUBLICATIONS

Taiwan Search Report for Application No. 107101933 dated Nov. 23, 2018.

*Primary Examiner* — Renan Luque
*Assistant Examiner* — Jianzi Chen
(74) *Attorney, Agent, or Firm* — Demian K. Jackson; Jackson IPG PLLC

(57) ABSTRACT

The invention relates to a lighting system of alternate current light-emitting diodes (AC-LEDs). The system includes a first, a second and a third AC-LED modules, each two of them being electrically connected in parallel to one another and further electrically connected to a first, a second or a third phase voltage input terminal. The respective AC-LED modules include a first and a second LED modules. The system is further provided with rectifier circuits and multi-stage driver modules. The invention involves driving the AC-LED modules to emit light in an alternate manner using a three-phase AC power source, thereby reducing the flicker index, and further driving the first and the second LED modules to light up in different alternating orders, thereby rendering the light emission of the AC-LED lighting system substantially constant in terms of power and brightness.

16 Claims, 8 Drawing Sheets

LIGHTING SYSTEM OF ALTERNATE CURRENT LIGHT-EMITTING DIODES

CROSS REFERENCE TO RELATED APPLICATION

This application claims priority to R.O.C. Patent Application No. 107101933 filed Jan. 19, 2018, which is hereby incorporated by reference in its entirety.

BACKGROUND OF INVENTION

1. Field of the Invention

The present invention relates to a lighting system of AC-LEDs which can reduce the flicker index of the overall lighting system effectively without an energy storage component and maintain a low total harmonic distortion (THD) and a high power factor (PF) while enhancing the lifespan and reliability.

2. Description of Related Art

Light-emitting diodes (LEDs) are a type of luminous semiconductor electronic devices developed as early as in 1962. They only emitted low-brightness red light at early stages, and other monochromatic sources were gradually developed later. Up to now, they may emit visible light, infrared and ultraviolet, and the brightness is increased to a high level. It was used as indicator lamps and display panels at first. With the emergence of white LEDs, they have been used in different lighting devices universally. For example, the high brightness LEDs have been extensively used in traffic lights, vehicle indicator lamps and stoplight devices. In recent years, the lighting equipments using high voltage LED strings were developed to replace conventional incandescent lamps and fluorescent lamps. For different structure, wavelength and power specifications, the operating voltage VF of LEDs is about 2~3.6V, the working current IF is about 1 mA~1500 mA. Due to the unidirectional conductivity of LEDs, they shall be supplied with DC power for normal luminescence.

Many kinds of linear LED driver circuits which can be directly driven by AC power supplies have been developed. In the simplest linear driver circuits, the bridge rectifier converts the input AC voltage into pulsed DC voltage (V), while the LED lamp string(s) is connected in series to the constant current circuit and connected to the positive and negative (+/−) output terminals of bridge rectifier. This connection has a very short duty cycle of LED lamp string (s), as well as a serious problem that the total luminous quantity is likely to be influenced by the voltage variation of AC power supply. In order to increase the duty cycle of LED lamp string(s) to 100%, and to prevent the luminous quantity of LED lamp string(s) from being influenced by the voltage fluctuation of the AC power supply, the simplest way is to connect a high capacity capacitor (generally a low-cost electrolytic capacitor) in parallel to the positive and negative (+/−) output terminals of the bridge rectifier.

When this capacitor is connected in parallel, said merits can be obtained, but there are considerable defects. As the internal resistance of the mains supply system is quite low, when the mains supply begins to charge the capacitor, an extremely large current surge is generated. This current surge not only reduces the PF value of the overall driver device greatly, but also increases the THD of the overall driver device greatly. The two phenomena result in a lot of limitations of the overall driver device. Added to this, the large current surge has a considerable influence on the lifespan of the capacitor.

Therefore, the non-inductive/capacitive AC-driven LED device came up to the market, which is applicable to a three-phase AC power supply system, as shown in FIG. 1. It is provided with a three-phase full-bridge rectifier circuit 11 for rectifying a three-phase AC power supply 12, and the rectified voltage is supplied to multiple AC-LED modules 13 connected in series, hoping to reduce the flicker and the failure rate of electrolytic capacitor. However, the Flicker Index of this LED device is still unsatisfactory, having an actual Flicker Index value of 3~8 (different output powers) and a high THD and a low PF.

SUMMARY OF THE INVENTION

Therefore, in the first aspect provided herein is a lighting system of AC-LEDs which can reduce the flicker index of the overall lighting system effectively without an energy storage component and maintain a low THD and a high PF while enhancing the lifespan and reliability.

The invention provides a lighting system of AC-LEDs, which comprises a first, a second and a third AC-LED modules, each including a first and a second nodes and a first and a second LED modules interconnected between the first and second nodes; at least three rectifier circuits, each including a first and a second rectified output terminals and a first, a second, a third and a fourth unidirectional elements, the first and second unidirectional elements are connected in series and in the same direction between the first node and the first LED module, the third and fourth unidirectional elements are connected in series and in the same direction between the second node and the second LED module, and the positive terminals of the first and third unidirectional elements are connected to the first and second nodes respectively, the negative terminals of the first and fourth unidirectional elements are connected to the second rectified output terminal, the negative terminals of the second and third unidirectional elements are connected to the first rectified output terminal; a first, a second and a third multi-stage driver modules, which are connected between the positive terminal of the second unidirectional element and the positive terminal of the fourth unidirectional element of each rectifier circuit respectively; a first phase voltage input terminal, connected to the first node of the first AC-LED module, the second node of the third AC-LED module and the first multi-stage driver module; a second phase voltage input terminal, connected to the second node of the first AC-LED module, the first node of the second AC-LED module and the second multi-stage driver module; a third phase voltage input terminal, connected to the second node of the second AC-LED module, the first node of the third AC-LED module and the third multi-stage driver module.

The invention further provides a lighting system of AC-LEDs, which comprises a first, a second and a third AC-LED modules, each including a first and a second nodes and at least two LED modules interconnected between the first and second nodes; at least three rectifier circuits, each including a first and a second rectified output terminals and a first, a second, a third and a fourth unidirectional elements respectively, the first and second unidirectional elements are connected in series and in the same direction between the first node and the first LED module, the third and fourth unidirectional elements are connected in series and in the same direction between the second node and the second LED module, and the positive terminals of the first and third unidirectional elements are connected to the first and second nodes respectively, the negative terminals of the first and fourth unidirectional elements are connected to the second rectified output terminal, the negative terminals of the second and third unidirectional elements are connected to the first rectified output terminal; a first, a second and a third multi-stage driver modules, connected between the positive terminal of the second unidirectional element and the positive terminal of the fourth unidirectional element of each rectifier circuit respectively; a first phase voltage input terminal, connected to the first node of the first AC-LED module and the first multi-stage driver module; a second phase voltage input terminal, connected to the first node of the second AC-LED module and the second multi-stage driver module; a third phase voltage input terminal, connected to the first node of the third AC-LED module and the third multi-stage driver module; an electrode tip, connected to the second node of the first, second and third AC-LED modules.

In a preferred embodiment, the aforementioned electrode tip is adapted for connection to the neutral line (N) of a three-phase AC power supply.

In a preferred embodiment, the first phase voltage input terminal is connected to the first three-phase AC power line (R) of a three-phase AC power supply, the second phase voltage input terminal is connected to the second three-phase AC power line (S) of the three-phase AC power supply, the third phase voltage input terminal is connected to the third three-phase AC power line (T) of the three-phase AC power supply.

In a preferred embodiment, the aforementioned unidirectional element is a rectifier diode or a LED.

In a preferred embodiment, the first, second, third and fourth multi-stage driver modules have at least a first, a second, a third and a fourth input terminals respectively, the first input terminal is connected between the first LED module and the positive terminal of the second unidirectional element; and the second input terminal is connected between the second LED module and the positive terminal of the fourth unidirectional element.

In a preferred embodiment, the third input terminal of the first multi-stage driver module is connected to the first phase voltage input terminal, and the fourth input terminal of the first multi-stage driver module is connected to the second phase voltage input terminal.

In a preferred embodiment, the third input terminal of the second multi-stage driver module is connected to the second phase voltage input terminal, and the fourth input terminal of the second multi-stage driver module is connected to the third phase voltage input terminal.

In a preferred embodiment, the third input terminal of the third multi-stage driver module is connected to the third phase voltage input terminal, and the fourth input terminal of the third multi-stage driver module is connected to the first phase voltage input terminal.

In a preferred embodiment, the first, second, third and fourth multi-stage driver modules are multi-stage driver elements or current limiting elements.

DETAILED DESCRIPTION OF THE INVENTION

Unless specified otherwise, the following terms as used in the specification and appended claims are given the following definitions. It should be noted that the indefinite article "a" or "an" as used in the specification and claims is intended to mean one or more than one, such as "at least one," "at least two," or "at least three," and does not merely refer to a singular one. In addition, the terms "comprising/comprises," "including/includes" and "having/has" as used in the claims are open languages and do not exclude unrecited elements. The term "or" generally covers "and/or", unless otherwise specified. The terms "about" and "substantially" used throughout the specification and appended claims are used to describe and account for small fluctuations or slight changes that do not materially affect the nature of the invention.

Figure 1:
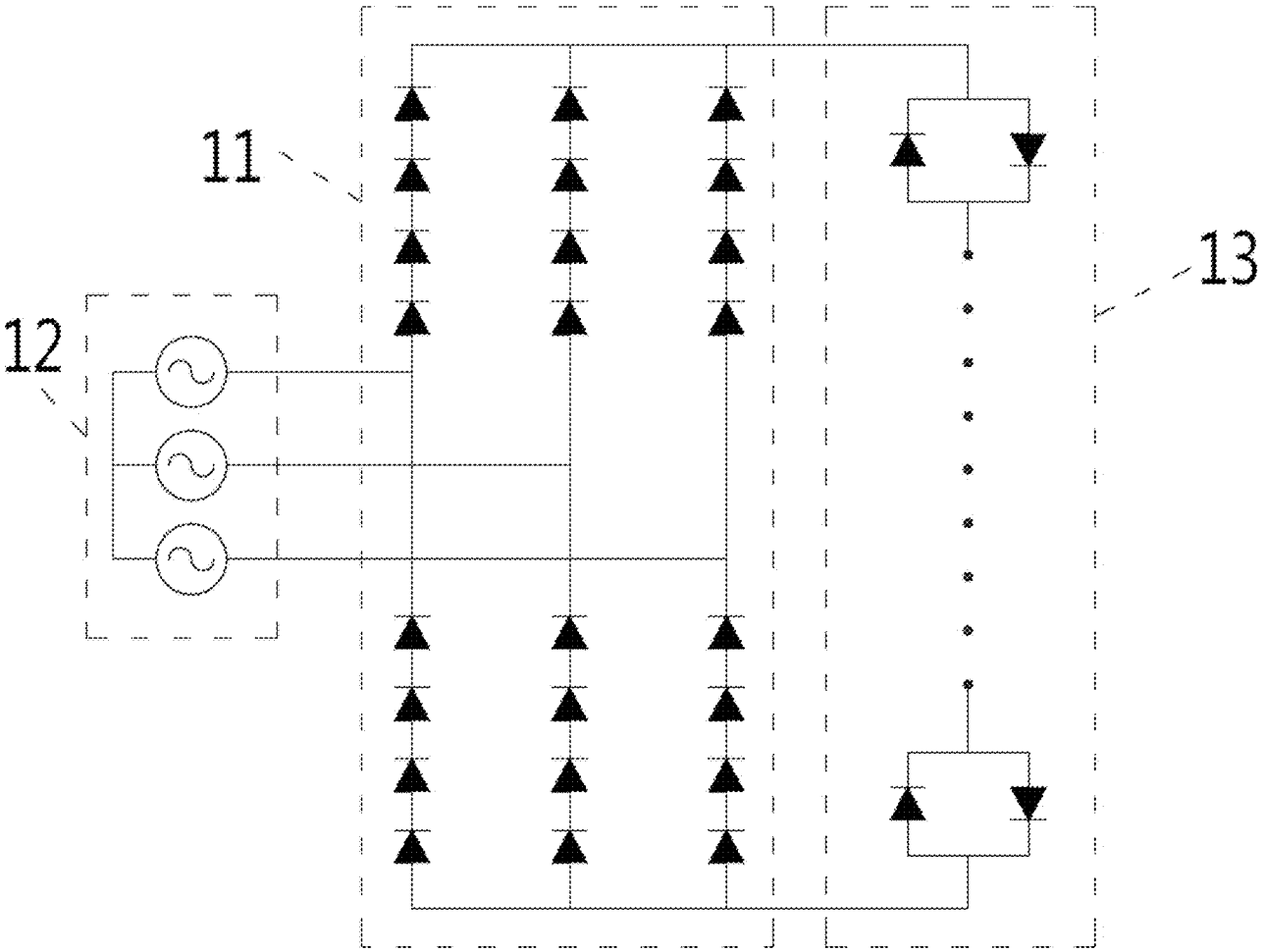
FIG.1 PRIOR ART
FIG. 1 is the schematic diagram of a conventional LED device.
Figure 2:
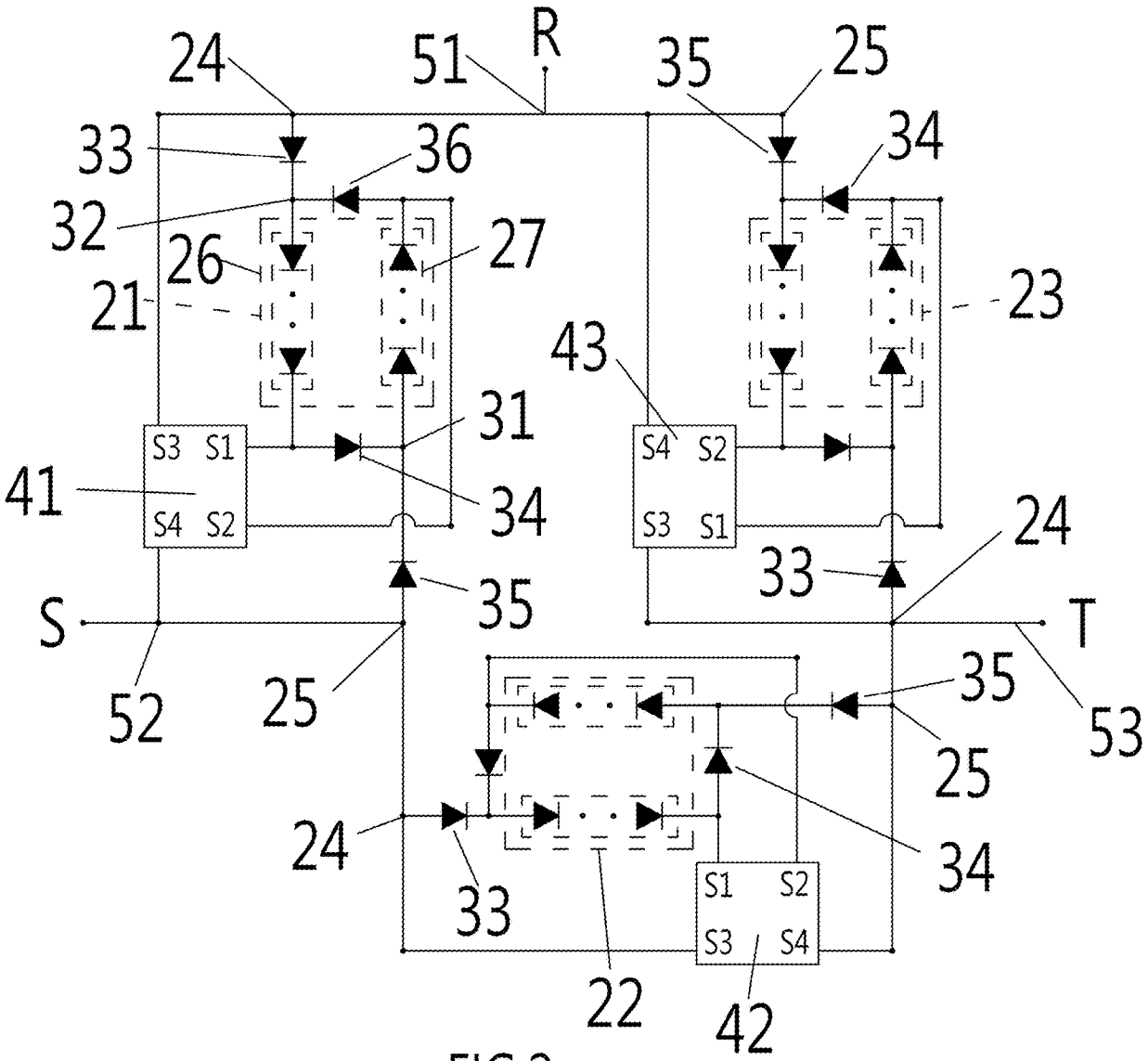
FIG. 2 is a schematic diagram of the AC-LED lighting system according to the first embodiment of the invention.

According to the first embodiment shown in FIG. 2, the AC-LED lighting system disclosed herein comprises a first, a second and a third AC-LED modules 21, 22, 23; at least three rectifier circuits; a first, a second and a third multi-stage driver modules 41, 42, 43; and a first, a second and a third phase voltage input terminals 51, 52, 53.

The first, second and third AC-LED modules 21, 22, 23 are substantially the same in structural arrangement, each including a first and a second nodes 24, 25, and a first and a second LED modules 26, 27 connected in parallel in opposite directions between the first and second nodes 24, 25. While only two oppositely and parallelly connected LED modules are described and illustrated herein, they may have other configurations and arrangements known by the persons with ordinary knowledge in the related art. Each of the LED modules may include one or more than one LED connected in-phase and in series.

Figure 3:
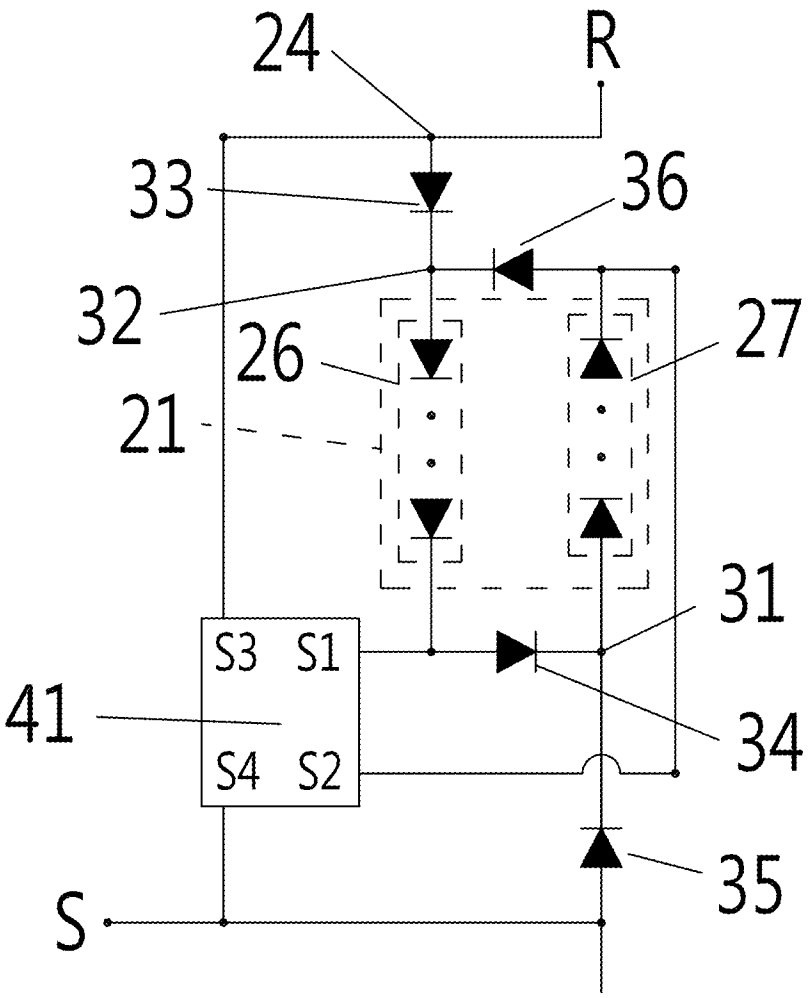
FIG. 3 is a schematic diagram of an exemplary AC-LED module according to the first embodiment of the invention.

At least three rectifier circuits are arranged in the first, second and third AC-LED modules 21, 22, 23 respectively, mainly for receiving an AC input power and rectifying the AC input power to a DC power. Referring to FIG. 3, each of the rectifier circuits includes a first and a second rectified output terminals 31, 32 and a first, a second, a third and a fourth unidirectional elements 33, 34, 35, 36. The first and second unidirectional elements 33, 34 are connected in series and in the same direction between the first node 24 and the first LED module 26. The third and fourth unidirectional elements 35, 36 are connected in series and in the same direction between the second node 25 and the second LED module 27. The respective first and third unidirectional elements 33, 35 include a positive terminal connected to the first and second nodes 24, 25, respectively. The respective first and fourth unidirectional elements 33, 36 include a negative terminal connected to the second rectified output terminal 32, whereas the respective second and third unidirectional elements 34, 35 include a negative terminal connected to the first rectified output terminal 31. Said unidirectional elements may be rectifier diodes or LEDs.

The first, second and third multi-stage driver modules 41, 42, 43 are arranged in the first, second and third AC-LED modules 21, 22, 23, respectively, and connected between the positive terminal of the second unidirectional element 34 and the positive terminal of the fourth unidirectional element 36 in the respective rectifier circuits, wherein the first, second and third multi-stage driver modules 41, 42, 43 may be multi-stage driver elements or current-limiting elements. The first, second and third multi-stage driver modules 41, 42, 43 may be set to have multi-stage light-up voltages. According to the embodiment shown in FIG. 3, a first stage and a second stage light-up voltages are set to correspond to the first and second LED modules 26, 27, respectively.

The first phase voltage input terminal 51 is connected to the first node 24 of the first AC-LED module 21, the second node 25 of the third AC-LED module 23 and the first and third multi-stage driver modules 41, 43.

The second phase voltage input terminal 52 is connected to the second node 25 of the first AC-LED module 21, the first node 24 of the second AC-LED module 22 and the first and second multi-stage driver modules 41, 42.

The third phase voltage input terminal 53 is connected to the second node 25 of the second AC-LED module 22, the first node 24 of the third AC-LED module 23 and the second and third multi-stage driver modules 42, 43.

In a preferred embodiment, the first, second, third and fourth multi-stage driver modules 41, 42, 43 have at least a first, a second, a third and a fourth input terminals S1, S2, S3, S4, respectively. The first input terminal S1 is connected between the first LED module 26 and the positive terminal of the second unidirectional element 34. The second input terminal S2 is connected between the second LED module 27 and the positive terminal of the fourth unidirectional element 36. The third input terminal S3 of the first multi-stage driver module 41 is connected to the first phase voltage input terminal 51, whereas the fourth input terminal S4 of the first multi-stage driver module 41 is connected to the second phase voltage input terminal 52. The third input terminal S3 of the second multi-stage driver module 42 is connected to the second phase voltage input terminal 52, while the fourth input terminal S4 of the second multi-stage driver module 42 is connected to the third phase voltage input terminal 53. The third input terminal S3 of the third multi-stage driver module 43 is connected to the third phase voltage input terminal 53, whereas the fourth input terminal S4 of the third multi-stage driver module 43 is connected to the first phase voltage input terminal 51.

Figure 4:
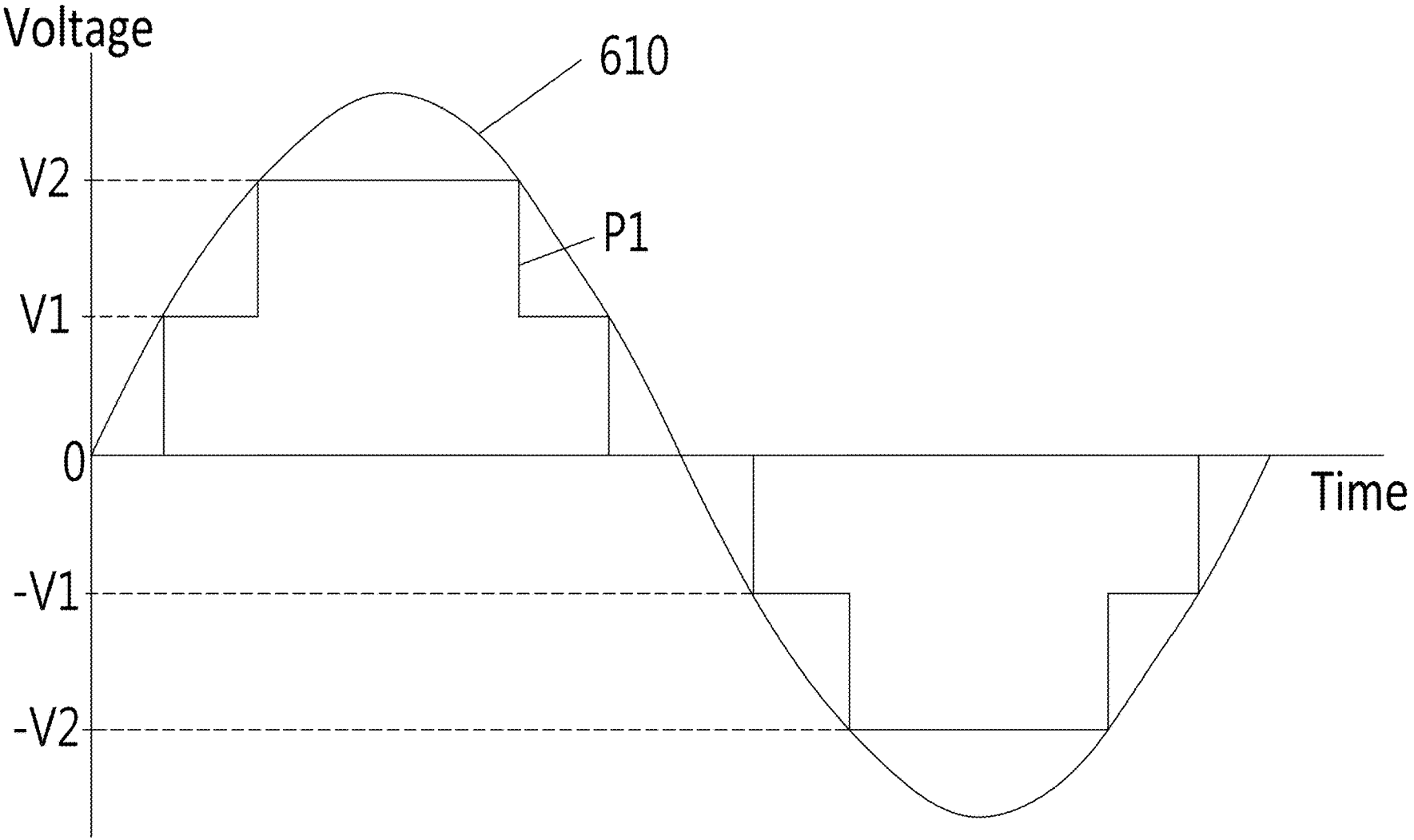
FIG. 4 is a schematic diagram showing a sinusoidal AC voltage waveform of the AC-LED module according to the invention.

As shown in FIG. 4, in an AC power supply cycle, as the input voltage 610 increases, the first LED module 26 and the second LED module 27 in each AC-LED module will be turned on to light up successively. In the positive half-cycle or the negative half-cycle ON state, the first and second LED modules 26, 27 are lightened in different alternating orders. In the positive half-cycle ON state, when the input voltage 610 increases to the first stage light-up voltage, the first input terminal S1 goes into operation, allowing the LED driving current to flow through the first input terminal S1, so that the first LED module 26 is turned on to light up. As the input voltage 610 increases continuously, making the voltage drop of the first input terminal S1 in relation to the second input terminal S2 reach the second stage light-up voltage, the driving current flow through the second input terminal S2. As a result, the first input terminal S1 is closed, and both of the first and the second LED modules 26, 27 are turned on to light up. On the contrary, as the input voltage 610 is decreased to a level lower than the light-up voltages of the respective stages, the second LED module 27 and the first LED module 26 will stop working successively. Because the first LED module 26 is arranged upstream in the flow path of the positive half-cycle, the first LED module 26 is turned on to light up before the second LED module 27 as the voltage increases.

The second LED module 27 is arranged upstream in the flow path of the negative half-cycle. Therefore, when the input voltage 610 increases to the first stage light-up voltage, the second input terminal S2 goes into operation, allowing the LED current flows through the second input terminal S2, so that the second LED module 27 is turned on to light up. As the input voltage 610 increases continuously, making the voltage drop of the second input terminal S2 in relation to the first input terminal S1 reach the second stage light-up voltage, the LED current flows through the first input terminal S1. As a result, the second input terminal S2 is closed, and both of the second and first LED modules 27, 26 are turned on to light up. Because the second LED module 27 is arranged upstream in the flow path of the negative half-cycle, the second LED module 27 is turned on to light up before the first LED module 26 as the voltage increases.

In the flow path of the positive half-cycle or negative half-cycle in the embodiment described above, the LED modules are turned on to light up in different orders, which is referred to herein by the sentence "respective LED modules are lightened in different alternating orders in the positive half-cycle or negative half-cycle ON state". As shown in FIG. 4, the first and second LED modules tend to have substantially the same light output power P1 and brightness in one AC power supplying cycle time, and the AC-LED problem of the uneven brightness of the light output from the conventional lighting system can be improved greatly. As the first and second LED modules are turned on to light up at the substantially same power output and exhibit substantially the same brightness, there will not be light and shade differences in vision.

Figure 5:
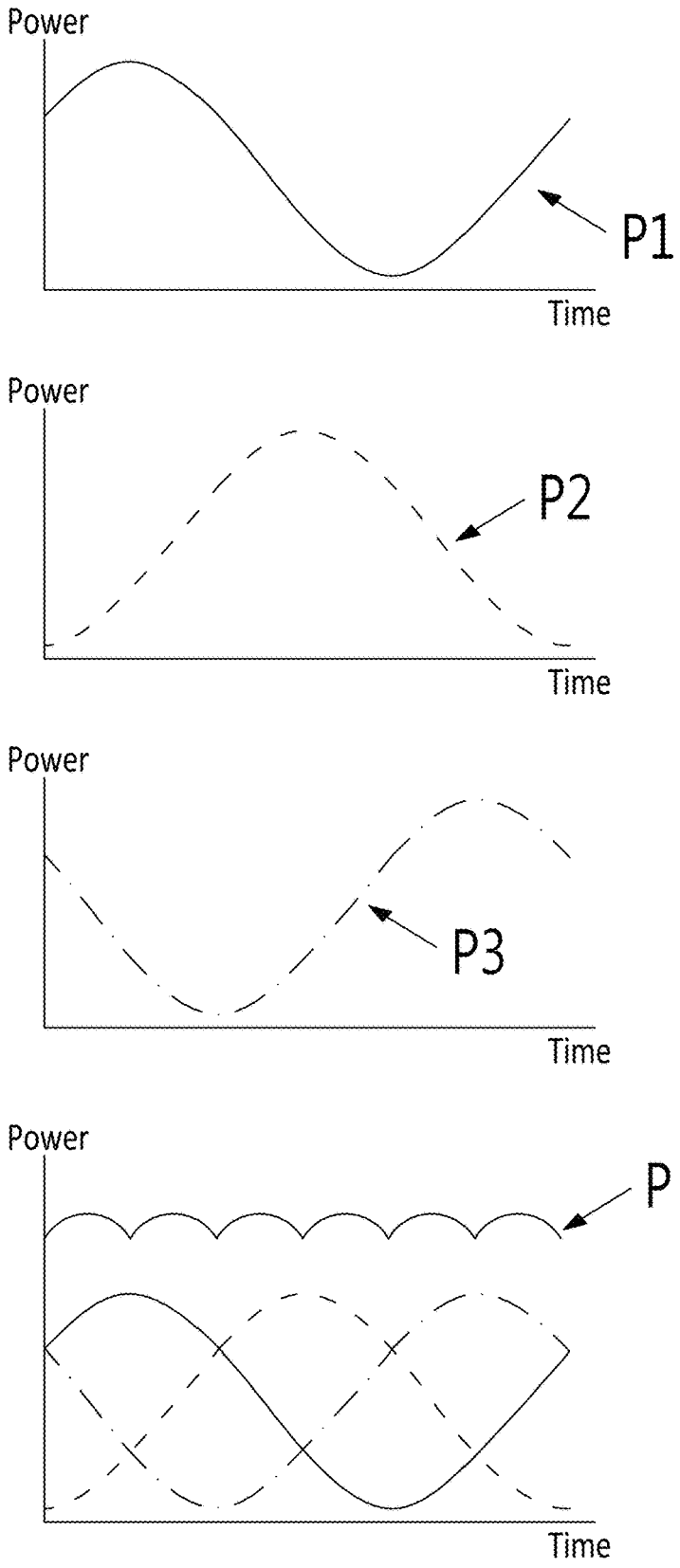
FIG. 5 is a schematic diagram showing the light output power waveforms of the AC-LED modules shown in FIG. 2 which are driven by a three-phase AC power supply.

The invention disclosed herein is useful in a three-phase AC power supplying system, wherein the first phase voltage input terminal 51 is connected to the first three-phase AC power line (R) of a three-phase AC power supply, the second phase voltage input terminal 52 is connected to the second three-phase AC power line (S) of the three-phase AC power supply, and the third phase voltage input terminal 53 is connected to the third three-phase AC power line (T) of the three-phase AC power supply which supplies a first, a second and a third phase voltages at the same magnitude and with a phase difference of 120 degrees, so as to allow the brightness of the AC-LED modules to vary with the rectified voltages. As the three rectified voltages have different phases, the respective AC-LED modules reaches its maximum brightness at different times. According to the invention, the respective AC-LED modules tend to have substantially the same power and brightness in an AC power supplying cycle. As shown in FIG. 5, the light output power P1 of the first AC-LED module, the light output power P2 of the second AC-LED module, the light output power P3 of the third AC-LED module and the total light output power P of the three AC-LED modules are illustrated from the top panel to the bottom panel. Since the light output powers of the AC-LED modules have a substantially identical waveform with a phase difference of about 120 degrees, and the power rise of one of the waveforms would overlap with and be compensated by the power drop zone of another one of the waveforms. As such, the total light output power would be kept substantially constant, and the flicker of the overall output light source is reduced. When the input power is 10 W, the AC-LED lighting system according to this embodiment has a THD of 9%. The THD is measured to be 14.6%, in the case where the input power is 130 W. All of these meet the specification of IEC 61000-3-2 Class C.

Figure 6:
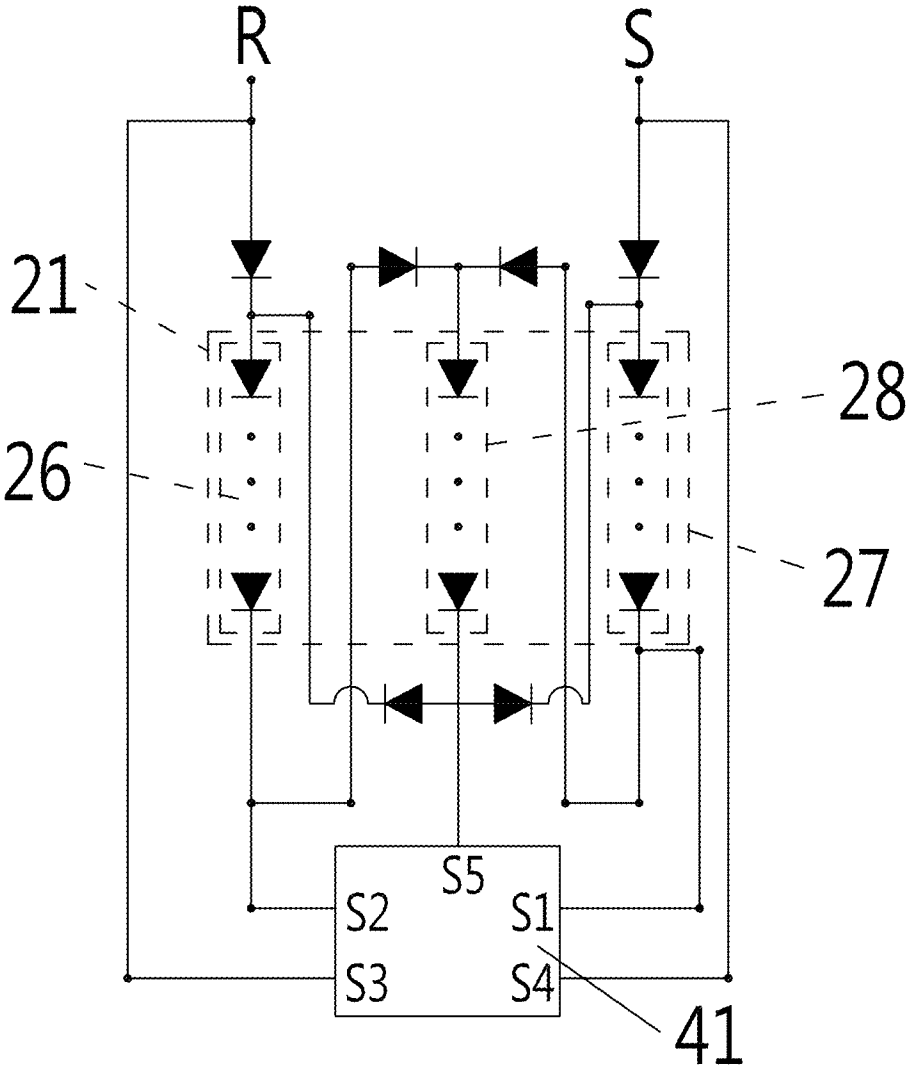
FIG. 6 is a schematic diagram of another exemplary AC-LED module according to the first embodiment of the invention.
Figure 7:
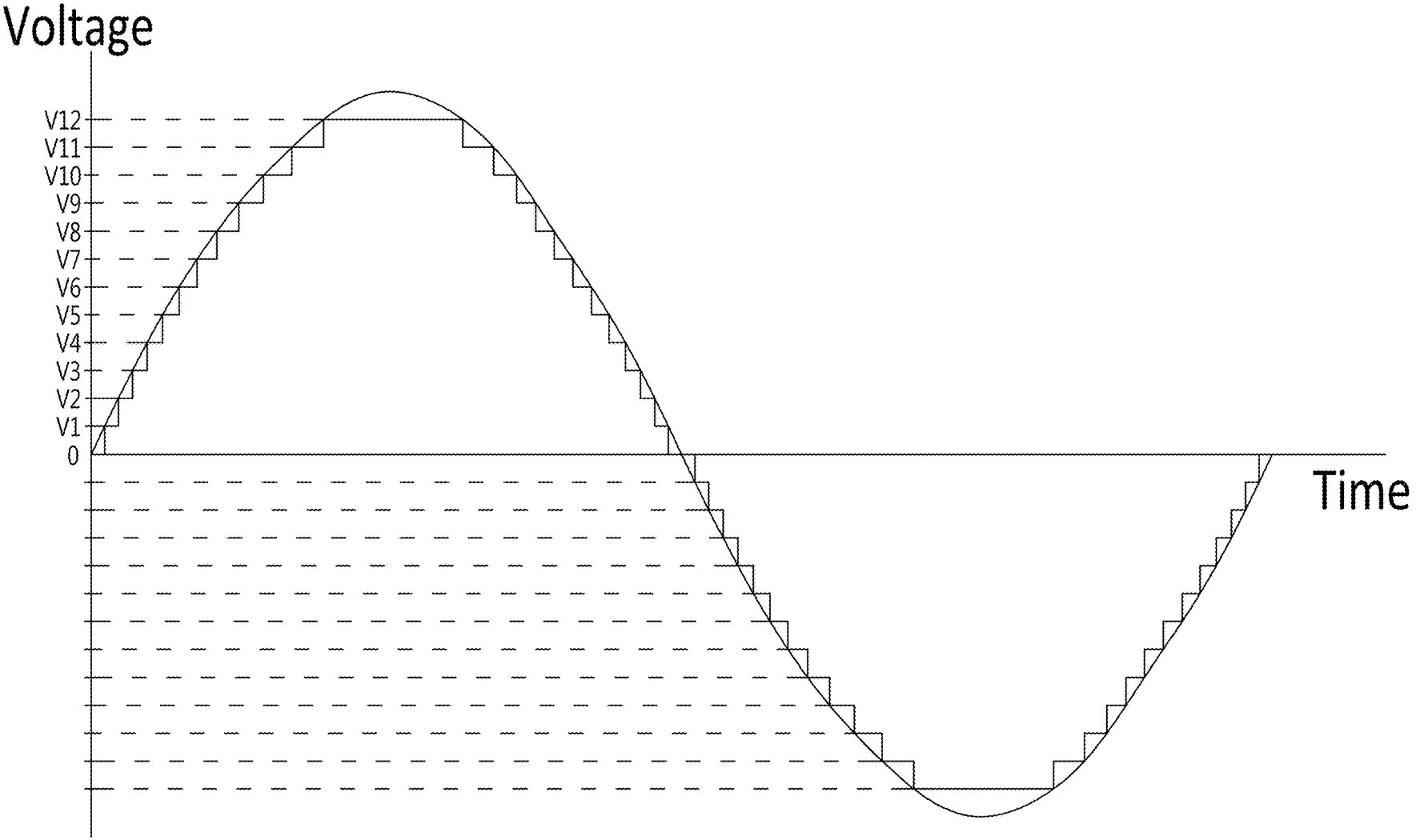
FIG. 7 is a schematic diagram showing another sinusoidal AC voltage waveform of the AC-LED module according to the invention.

While the multi-stage driver module illustrated herein is a two-stage driver module set with a first- and a second-stage light-up voltages corresponding to the first and second LED modules, each AC-LED module may include more LED modules and may be connected to additional multi-stage driver module(s). In another preferred embodiment shown in FIG. 6, the respective AC-LED modules are provided with a first, a second and a third LED modules 26, 27, 28. FIG. 6 takes the first AC-LED module 21 as an example, wherein the first multi-stage driver module 41 is further provided with a fifth input terminal S5 and set with a first-stage, a second-stage and a third-stage light-up voltages corresponding to the first, second and third LED modules 26, 27, 28, respectively. In a more preferred embodiment, each of the AC-LED modules is provided with 12 LED modules, and the multi-stage driver module is a 12-stage driver module set with a first- to a twelfth-stage light-up voltages V1~V12, as shown in FIG. 7. It has been measured in terms of the power efficiency in this embodiment, the THD is 5.2%, and the PF is 0.999.

Figure 8:
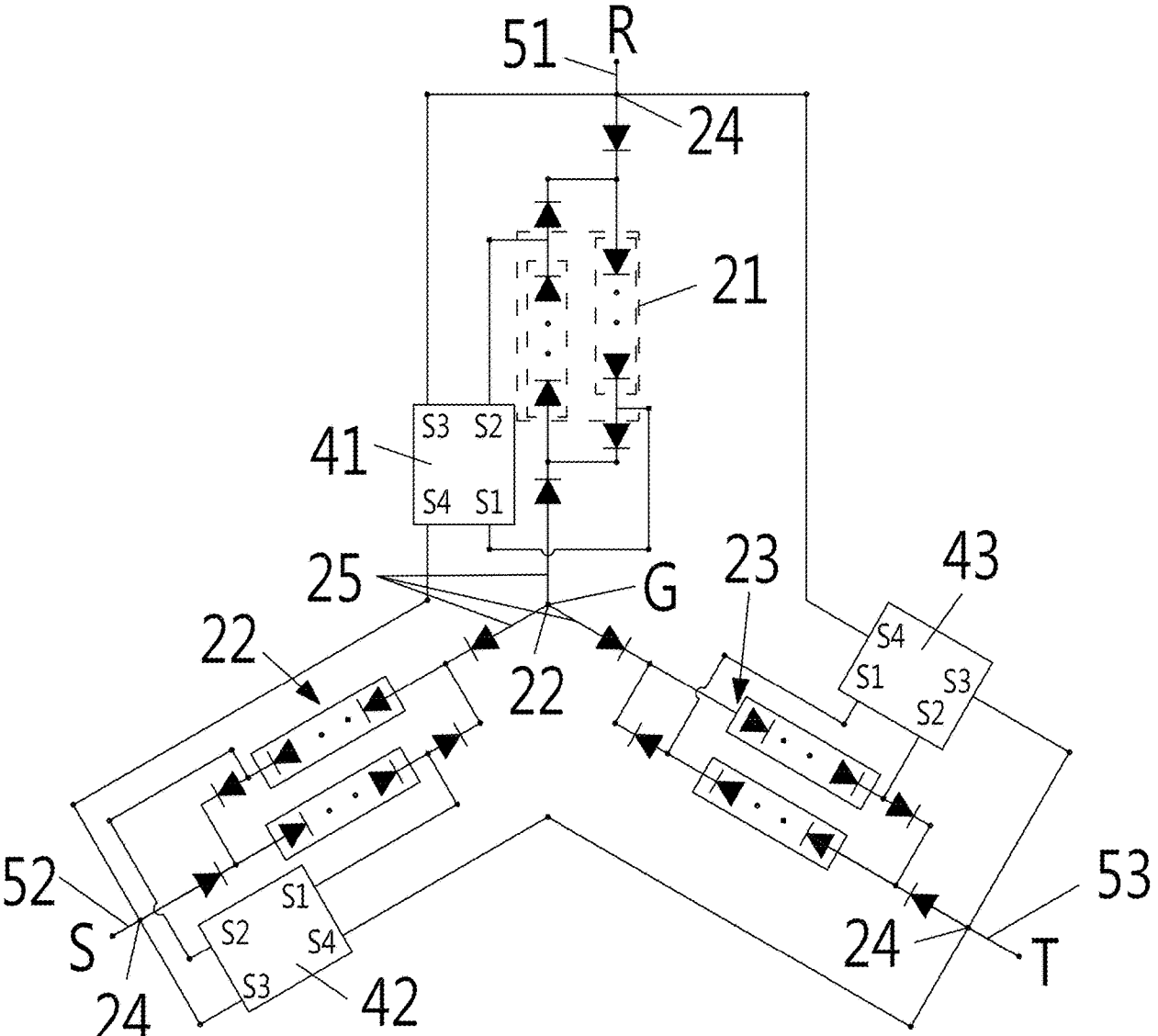
FIG. 8 is a schematic diagram of the AC-LED lighting system according to the second embodiment of the invention.

FIG. 8 shows the second embodiment of the invention, whose configuration is substantially the same as that of the first embodiment, with a difference in that a three-phase four-wire power system is used in the second embodiment. The first phase voltage input terminal 51 is connected to the first node 24 of the first AC-LED module 21 and the first multi-stage driver module 41. The second phase voltage input terminal 52 is connected to the first node 24 of the second AC-LED module 22 and the second multi-stage driver module 42. The third phase voltage input terminal 53 is connected to the first node 24 of the third AC-LED module 23 and the third multi-stage driver module 43. In addition, an electrode tip G is connected to the second nodes 25 of the first, second and third AC-LED modules 21, 22, 23 and adapted for connection to the neutral line (N) of a three-phase AC power supply.

As known by those with ordinary skill in the related art, the flicker phenomenon may change periodically, which can be defined by the amplitude in waveform, average level, cyclic frequency, shape and/or the variation of duty cycle. Normally, the flicker is quantized by Percent Flicker and Flicker Index. To further describe the effectiveness of the invention, a hand-held spectrophotometer (United Power Research Technology Corp., Model MF205N) was used to measure the light output light from the AC-LED lighting system according to the first embodiment of the invention. The data thus obtained are shown in Table 1 below.

TABLE 1

| | The First Embodiment |
|---|---|
| Flicker Index | 0.043 |
| Percent Flicker (%) | 18.7 |
| SVM | 0.189 |
| Frequency (Hz) | 360 |

Based on the measurement made by the hand-held spectrophotometer, the lower the Percent Flicker and Flicker Index are, the less noticeable is the flicker phenomenon. The SVM (Stroboscopic Effect Visibility Measure) is a measure for quantizing the visibility of high frequency flicker, where the frequency range is 80 Hz~2000 Hz, the sampling time is at least 1 s, the minimum sampling rate is 4000 times/s. The Fast Fourier Transform was implemented for the measured light output waveform, and the result was combined with the frequency response function of human eye. When SVM=1, slightly visible. When SVM<1, invisible. When SVM>1, clearly visible. According to said measured data, the Flicker Index, Percent Flicker and SVM values of the invention are very low, and SVM<1; so the flicker of the invention is extremely low.

Therefore, the AC-LED lighting system disclosed herein can reduce the flicker index of AC-LED module effectively in the absence of an energy storage component and maintain a low THD and a high PF while the lifespan and reliability are enhanced.

While the present invention has been described in detail herein, various modifications or changes within the spirit and scope of the present invention will be apparent to those skilled in the art. In view of the above disclosure, knowledge in the relevant art and the entire contents of documents discussed in the background and detailed description sections above are incorporated herein in their entirety for reference.

We claim:

1. A lighting system of AC-LEDs, comprising:

a first, a second and a third AC-LED modules, each including a first and a second nodes, and a first and a second LED modules interconnected between the first and second nodes;

at least three rectifier circuits, each having a first and a second rectified output terminals and a first, a second, a third and a fourth unidirectional elements, wherein the first and second unidirectional elements are connected in series and in the same direction between the first node and the first LED module, the third and fourth unidirectional elements are connected in series and in the same direction between the second node and the second LED module, and the respective first and third unidirectional elements include a positive terminal connected to the first and second nodes, respectively, the respective first and fourth unidirectional elements include a negative terminal connected to the second rectified output terminal, and the respective second and third unidirectional elements include a negative terminal connected to the first rectified output terminal;

a first, a second and a third multi-stage driver modules, connected between the positive terminal of the second unidirectional element and the positive terminal of the fourth unidirectional element in each of the rectifier circuits, respectively;

a first phase voltage input terminal, connected to the first node of the first AC-LED module, the second node of the third AC-LED module and the first multi-stage driver module;

a second phase voltage input terminal, connected to the second node of the first AC-LED module, the first node of the second AC-LED module and the second multi-stage driver module; and a third phase voltage input terminal, connected to the second node of the second AC-LED module, the first node of the third AC-LED module and the third multi-stage driver module.

2. The system defined in claim 1, wherein the first phase voltage input terminal is connected to the first three-phase AC power line (R) of a three-phase AC power supply, the second phase voltage input terminal is connected to the second three-phase AC power line (S) of the three-phase AC power supply, and the third phase voltage input terminal is connected to the third three-phase AC power line (T) of the three-phase AC power supply.

3. The system defined in claim 2, wherein the unidirectional element is selected from the group consisting of a rectifier diode and a LED.

4. The system defined in claim 1, wherein each of the first, second, third and fourth multi-stage driver modules includes at least a first, a second, a third and a fourth input terminals, wherein the first input terminal is connected between the first LED module and the positive terminal of the second unidirectional element and the second input terminal is connected between the second LED module and the positive terminal of the fourth unidirectional element.

5. The system defined in claim 4, wherein the third input terminal of the first multi-stage driver module is connected to the first phase voltage input terminal, and the fourth input terminal of the first multi-stage driver module is connected to the second phase voltage input terminal.

6. The system defined in claim 4, wherein the third input terminal of the second multi-stage driver module is connected to the second phase voltage input terminal, and the fourth input terminal of the second multi-stage driver module is connected to the third phase voltage input terminal.

7. The system defined in claim 4, wherein the third input terminal of the third multi-stage driver module is connected to the third phase voltage input terminal, and the fourth input terminal of the third multi-stage driver module is connected to the first phase voltage input terminal.

8. The system defined in claim 4, wherein the first, second, third and fourth multi-stage driver modules are selected from the group consisting of multi-stage driver elements and current limiting elements.

9. A lighting system of AC-LEDs, comprising:

a first, a second and a third AC-LED modules, each including a first and a second nodes and at least two LED modules interconnected between the first and second nodes;

at least three rectifier circuits, each including a first and a second rectified output terminals and a first, a second, a third and a fourth unidirectional elements, wherein the first and second unidirectional elements are connected in series and in the same direction between the first node and the first LED module, the third and fourth unidirectional elements are connected in series and in the same direction between the second node and the second LED module, and the respective first and third unidirectional elements include a positive terminal connected to the first and second nodes, respectively, the respective first and fourth unidirectional elements include a negative terminal connected to the second rectified output terminal, and the respective second and third unidirectional elements include a negative terminal connected to the first rectified output terminal;

a first, a second and a third multi-stage driver modules, connected between the positive terminal of the second unidirectional element and the positive terminal of the fourth unidirectional element in each of the rectifier circuits, respectively;

a first phase voltage input terminal, connected to the first node of the first AC-LED module and the first multi-stage driver module;

a second phase voltage input terminal, connected to the first node of the second AC-LED module and the second multi-stage driver module;

a third phase voltage input terminal, connected to the first node of the third AC-LED module and the third multi-stage driver module; and an electrode tip, connected to the second node of the first, second and third AC-LED modules.

10. The system defined in claim 9, wherein the electrode tip is adapted for connection to a neutral line (N) of a three-phase AC power supply.

11. The system defined in claim 10, wherein the first phase voltage input terminal is connected to the first three-phase AC power line (R) of a three-phase AC power supply, the second phase voltage input terminal is connected to the second three-phase AC power line (S) of the three-phase AC power supply, and the third phase voltage input terminal is connected to the third three-phase AC power line (T) of the three-phase AC power supply.

12. The system defined in claim 11, wherein the unidirectional element is selected from the group consisting of a rectifier diode and a LED.

13. The system defined in claim 10, wherein each of the first, second, third and fourth multi-stage driver modules includes at least a first, a second, a third and a fourth input terminals, wherein the first input terminal is connected between the first LED module and the positive terminal of the second unidirectional element and the second input terminal is connected between the second LED module and the positive terminal of the fourth unidirectional element.

14. The system defined in claim 9, wherein the first phase voltage input terminal is connected to the first three-phase AC power line (R) of a three-phase AC power supply, the second phase voltage input terminal is connected to the second three-phase AC power line (S) of the three-phase AC power supply, and the third phase voltage input terminal is connected to the third three-phase AC power line (T) of the three-phase AC power supply.

15. The system defined in claim 14, wherein the unidirectional element is selected from the group consisting of a rectifier diode and a LED.

16. The system defined in claim 9, wherein each of the first, second, third and fourth multi-stage driver modules includes at least a first, a second, a third and a fourth input terminals, wherein the first input terminal is connected between the first LED module and the positive terminal of the second unidirectional element and the second input terminal is connected between the second LED module and the positive terminal of the fourth unidirectional element.

* * * * *